US007992405B2

(12) United States Patent
Cushen

(10) Patent No.: US 7,992,405 B2
(45) Date of Patent: Aug. 9, 2011

(54) DRAIN PAN AND METHOD FOR FABRICATING A DRAIN PAN

(75) Inventor: Stan W. Cushen, Cypress, TX (US)

(73) Assignee: Goodman Manufacturing Company, L.P., Houston, TX (US)

( * ) Notice: Subject to any disclaimer, the term of this patent is extended or adjusted under 35 U.S.C. 154(b) by 400 days.

(21) Appl. No.: 11/998,900

(22) Filed: Dec. 3, 2007

(65) Prior Publication Data

US 2008/0134705 A1 Jun. 12, 2008

Related U.S. Application Data

(60) Provisional application No. 60/873,107, filed on Dec. 6, 2006.

(51) Int. Cl.
*F25D 21/14* (2006.01)

(52) U.S. Cl. ..... 62/285

(58) Field of Classification Search ..... 62/285, 62/291

See application file for complete search history.

(56) References Cited

U.S. PATENT DOCUMENTS

| | | | | |
|---|---|---|---|---|
| 3,712,631 | A | 1/1973 | Forchini et al. | |
| 4,428,602 | A | 1/1984 | Lambot et al. | |
| 4,679,405 | A * | 7/1987 | Mitchell et al. | 62/285 |
| 5,109,929 | A * | 5/1992 | Spears | 169/16 |
| 5,437,481 | A * | 8/1995 | Spears et al. | 285/148.13 |

OTHER PUBLICATIONS

Advertisement "Transition Fittings—Strong and Reliable Metal-to-Plastic Transitions" BR-2-0200 for Spears Manufacturing Company, Nov. 2000.

USCO Utilities Supply Company catalog 2002B, p. 108 entitled "PVC Transition Fittings".

* cited by examiner

*Primary Examiner* — Melvin Jones

(74) *Attorney, Agent, or Firm* — Greenberg Traurig L.L.P.; Ben D. Tobor

(57) ABSTRACT

A drain pan and a method for fabricating a drain pan for use with an air conditioner, the drain pan having a plastic drain having plastic threads, with an insert disposed within the plastic drain to prevent the fracturing of the plastic threads when a steel pipe is threaded into the plastic drain. The insert may be a metal insert.

24 Claims, 1 Drawing Sheet

DRAIN PAN AND METHOD FOR FABRICATING A DRAIN PAN

RELATED APPLICATION

This application claims the benefit, and priority benefit, of U.S. provisional patent application Ser. No. 60/873,107, filed Dec. 6, 2006, entitled Drain Pan and Method for Fabricating a Drain Pan.

BACKGROUND OF THE INVENTION

1. Field of the Invention

The invention relates generally to a drain pan which collects condensate from an air conditioner and a method for fabricating such drain pans.

2. Description of the Related Art

Known air conditioning systems include drain pans which collect and dispose of accumulated condensation, or condensate, and such drain pans, or trays, are typically disposed beneath an evaporator coil. Condensate is then drained out of the drain pan through an opening in the drain pan, or tray, and flows to a remote location. Presently available drain pans are formed of various types of moldable plastic material. Many times, it is necessary that the plastic drain pan be connected to a steel pipe to accommodate drainage of the condensate from the system and flow to the remote location. Typically, the installer of the air conditioning system, or a plumber, screws the steel pipe, typically a conventional ¾" steel pipe into the drain pan, which typically includes a drain, or customer connection, having a standard pipe thread connection, such as a tapered female pipe thread. A tapered pipe thread is shaped like a wedge and stresses known as "Hoop Stresses" are generated as the plumber threads the steel pipe into the tapered female threads of the plastic drain pan. When this connection is made with torque forces being exerted higher than those achieved by hand tightening of the pipe within the plastic threaded drain, the Hoop Stresses may achieve a level at which the plastic threads of the plastic drain may be fractured. Thus, the connection between the plastic drain pan and the steel pipe may leak condensate, which is a serious disadvantage and consequence from over-tightening the steel pipe into the plastic drain pan.

The drain pan and method of fabricating a drain pan, in accordance with certain embodiments of the present invention, as compared to previously proposed drain pans and methods for fabricating drain pans, have the advantages of: providing a plastic drain for the drain pan which is less susceptible of being fractured and leaking; and is economical to manufacture and use.

SUMMARY OF CERTAIN EMBODIMENTS OF THE INVENTION

In accordance with certain embodiments of the invention, the foregoing advantages are believed to have been achieved. A drain pan which may collect condensate from an air conditioner of one embodiment may include: a bottom wall and side walls, at least one of the side walls being formed of plastic, at least one opening in one of the at least one plastic side walls for the passage of condensate; a drain formed of plastic having an inner wall surface and an outer wall surface and first and second ends, the first end being disposed adjacent to, and in fluid communication with, the at least opening, whereby condensate may pass through the drain; at least a portion of the inner wall surface of the plastic drain having a plurality of threads formed of plastic; and an insert having an inner wall surface and an outer wall surface may be disposed within the plastic drain with at least a portion of the inner wall surface of the insert being disposed in a spaced relationship from the inner wall surface of the plastic drain. The drain may be an annular shaped member, and the insert may also be an annular shaped member. The insert may be formed of metal.

In accordance with another embodiment of the present invention, a method for fabricating a drain pan which may collect condensate from an air conditioner, may comprise the steps of: providing a bottom wall and side walls, at least one of the side walls being formed of plastic; providing at least one opening in one of the at least one plastic side walls for the passage of condensate; providing a drain formed of plastic having an inner wall surface and an outer wall surface and first and second ends, with the first end being disposed adjacent to, and in fluid communication with, the at least one opening, whereby condensate may pass through the drain; providing at least a portion of the inner wall surface of the plastic drain with a plurality of threads formed of plastic; and disposing an insert having an inner wall surface and an outer wall surface within the plastic drain with at least a portion of the inner wall surface of the insert being disposed in a spaced relationship from the inner wall surface of the plastic drain. In accordance with this embodiment, an annular shaped member may be utilized as the drain, and the insert may also be an annular shaped member. The insert may also be formed of metal.

The drain pan and method of fabricating a drain pan in accordance with certain embodiments of the present invention, when compared with previously proposed conventional drain pans and methods for fabricating drain pans, are believed to have the advantages of: preventing the fracturing of the threaded connection between the drain and a steel drain pipe; preventing leaks of condensate from the threaded connection between the steel drain pipe and plastic drain; and are economical to manufacture and use.

While certain embodiments of the present invention will be described in connection with the preferred embodiments shown herein, it will be understood that it is not intended to limit the invention to those embodiments. On the contrary, it is intended to cover all alternatives, modifications, and equivalents, as may be included within the spirit and scope of the invention as defined by the appended claims.

DETAILED DESCRIPTION OF SPECIFIC EMBODIMENTS

Figure 1:
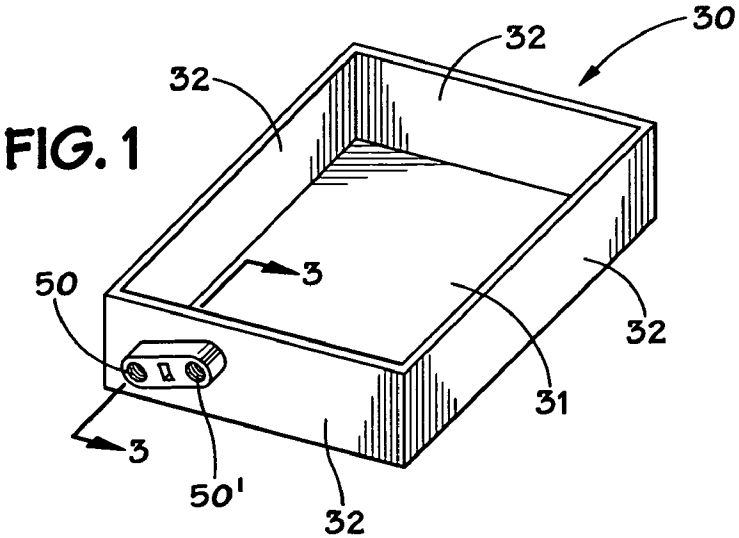
FIG. 1 is a perspective view of a drain pan for use with an air conditioner.
Figure 2:
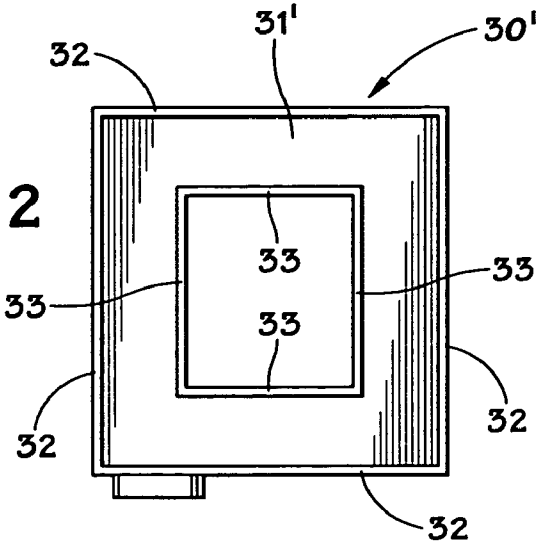
FIG. 2 is a top view of another type of drain pan.

With reference to FIG. 1, a drain pan 30, for collecting condensate from an air conditioner, or evaporator coil (not shown) in accordance with one embodiment of the present invention is shown to generally include: a bottom wall 31 and side walls 32. At least one of the side walls 32 is formed of a suitable plastic material having the requisite strength and corrosion resistance characteristics to be used as a drain pan which may collect condensate from an air conditioner, or evaporator coil. Primed reference numerals will be used for similar structures or components as those denoted with the same unprimed reference numerals. Preferably, bottom wall 31 and all the side walls 32 are formed of the same plastic material. The general shape of the drain pan 30 may be of any desired shape or configuration, as is required for the air conditioning equipment with which it is being used. For example, as shown in FIG. 2, drain pan 30' may include a bottom wall 31', outer side walls 32, and interior side walls 33, whereby a generally square or rectangular shaped drain pan 30' is provided with the bottom wall 31' and side walls 32 and 33 forming a trough, or container, for receiving and collecting the condensate. It will be readily apparent to one of ordinary skill in this field that the drain pan may have any desired configuration, as is desired, or required by the particular air conditioning equipment with which it is being used.

Figure 3:
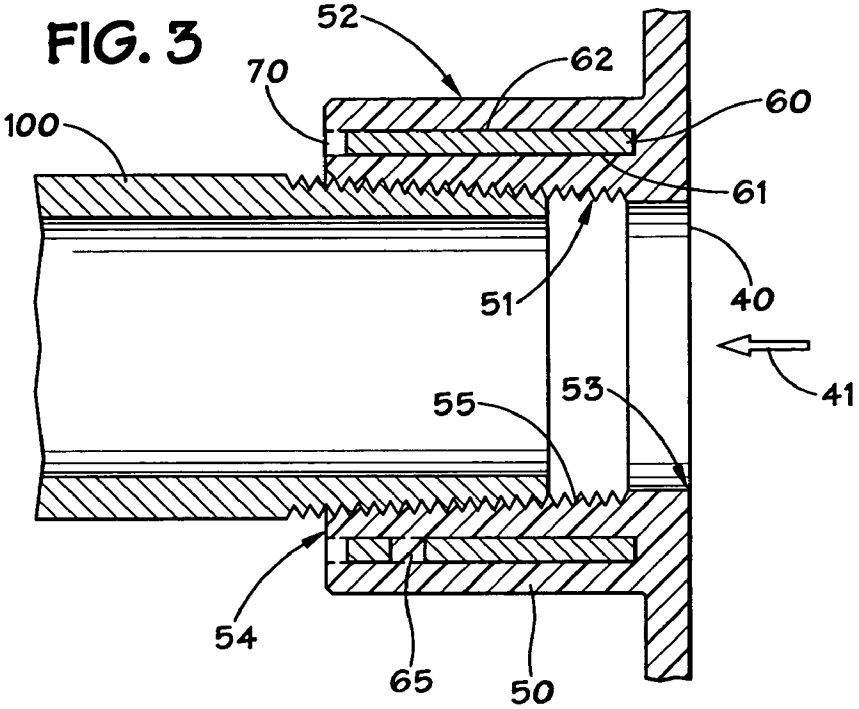
FIG. 3 is a partial cross-sectional view of a portion of the drain pan of FIG. 1 taken along line 3-3 of FIG. 1.

With reference to FIGS. 1 and 3, at least one opening 40 is provided in one of the side walls 32 for the passage of condensate, as indicated by arrow 41 (FIG. 3), outwardly from drain pan 30 through opening 40 into drain 50, and into a conventional threaded steel pipe 100. Drain 50 is formed of a suitable plastic material and has an inner wall surface 51 and an outer wall surface 52 and first and second ends 53, 54, with the first end 53 being disposed adjacent to, and in fluid communication with, opening 40 formed in side wall 32 of drain pan 30, whereby the condensate 41 may pass through the drain 50. At least a portion of the inner wall surface 51 of the plastic drain 50 has a plurality of threads, or pipe threads 55, and preferably pipe threads 55 are formed of the same plastic material as drain pan 30 and drain 50. Preferably, the plastic threads 55 provide a tapered, threaded connection for steel pipe 100.

Still with reference to FIGS. 1 and 3, an insert 60 having an inner wall surface 61 and an outer wall surface 62 is disposed within the plastic drain 50 with a least a portion of the inner wall surface 61 of the insert 60 being disposed in a spaced relationship from the inner wall surface 51 of the plastic drain 50. Preferably, drain 50 is an annular, or circular shaped, member extending outwardly from side wall 32, and the insert 60 is similarly preferably an annular, or circular shaped, member, or sleeve. If desired, an additional drain 50' of similar construction to that of drain 50 may be provided, as is known in the art. If drain 50 should become clogged, the additional, or supplemental, drain 50' may be utilized to connect another pipe 100 to drain pan 30.

Figure 4:
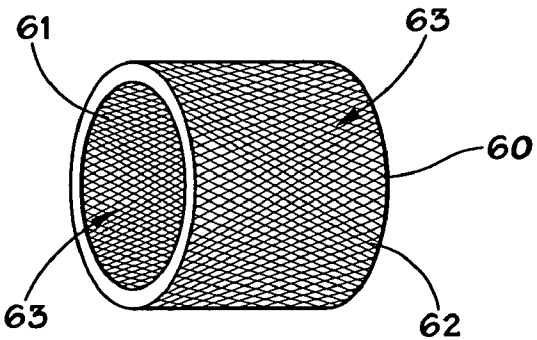
FIG. 4 is a perspective view of an insert shown in FIG. 3.

Preferably, drain 50 is formed integrally with side wall 32 of drain pan 30, as by a conventional injection molding process, or any other type of plastic forming process. Alternatively, if desired, drain 50 could be glued, heat sealed, or in some other manner secured to wall 32. The insert 60 may be disposed within the mold which either forms drain 50, or which integrally forms drain 50 and drain pan 30, whereby the plastic material forming drain 50 is present adjacent the inner and outer wall surfaces 61, 62 of insert, or sleeve, 60. If desired, insert 60 may have at least one opening 65 formed in the inner and outer wall surfaces 61, 62 of the insert 60, and the opening 65 may pass through insert 60. If at least one opening 65 is provided, or as many openings 65 as desired are provided, in insert 60, the plastic material of which drain 50 is formed may flow into the opening, or openings, 65 to better secure the insert within drain 50. Alternatively, if desired, as shown in FIG. 4, the outer wall surface 62, the inner wall surface 61, or both the inner and outer wall surfaces 61, 62 of insert 60 may be provided with a knurled finish 63 to increase the adhesion of the plastic of drain 50 to the inner and outer wall surfaces 61, 62 of insert 60.

With reference to FIG. 3, insert 60 is preferably disposed between the inner and outer wall surfaces 51, 52 of drain 50 and is completely surrounded by the plastic material forming drain 50. Upon an installer, or plumber, threading steel pipe 100 into drain 50, the insert 60 functions to reinforce drain 50 and in particular reinforce plastic threads 55 against the Hoop Stresses exerted upon drain 50 and threads 55 by the forces exerted by steel pipe 100 as it is threaded inwardly and torqued into the drain 50.

Preferably the insert 60 has a higher tensile strength than the plastic material utilized for drain 50, whereby the desired reinforcing force is provided. Thus, insert may be formed of a suitable metal, such as brass, steel, stainless steel, or any other suitable metal having the requisite strength characteristics to function in the desired manner herein described. Alternatively, insert 60 could be formed of a non-metallic material, such as a plastic material which also has a tensile strength greater than the plastic material of which the plastic drain is formed. Additionally, instead of molding insert 60 integrally within drain 50, as previously described, drain 50 may be formed, or molded, with an opening (as shown in phantom lines 70, FIG. 3) shaped to conform to the configuration of insert 60, including having the opening extend outwardly through the second end 54 of drain 50. Thus, after the plastic drain 50 and drain pan 30 are molded, the insert 60 may be pushed into the mating opening 70 within drain 50, whereby it is frictionally received within drain 50 in the configuration illustrated in FIG. 3. Additionally, it should be apparent to one of ordinary skill in the art that drain 50 may have any outer configuration for its other wall surface 52, such as hexagonal, square, etc., although an annular, or circular, configuration is preferred as previously described. Similarly, the configuration of insert 60 could have any desired cross-sectional configuration, such as square, hexagonal, etc., provided at least a portion of its inner wall surface 61 is disposed in a spaced relationship from the inner wall surface 51 of the plastic drain 50, whereby the desired reinforcing may be provided. As previously discussed, however, a generally circular, or annular shaped, configuration is preferred for insert 60.

Certain embodiments of the present invention have been described and illustrated. It will be understood to those skilled in the art that changes and modifications may be made without departing from the spirit and scope of the invention as set forth in the appended claims.

I claim:

1. A drain pan which may collect condensate from an air conditioner comprising:
   - a bottom wall and side walls, at least one of the side walls being formed of plastic;
   - at least one opening in one of the at least one plastic side walls for the passage of condensate;
   - a drain formed of plastic having an inner wall surface and an outer wall surface and first and second ends, the first end being disposed adjacent to, and in fluid communication with, the at least one opening, whereby condensate may pass through the drain;
   - at least a portion of the inner wall surface of the plastic drain having a plurality of threads formed of plastic; and
   - an insert having an inner wall surface and an outer wall surface is disposed between the inner and outer wall surfaces of the plastic drain and within the plastic drain, with the inner and outer wall surfaces of the insert being completely surrounded by the plastic forming the drain.

2. The drain pan of claim 1, wherein all the side walls are formed of plastic.

3. The drain pan of claim 1, wherein the drain is an annular shaped member.

4. The drain pan of claim 1, wherein the insert is formed of metal and is an annular shaped member.

5. The drain pan of claim 1, wherein the insert has at least one opening formed in the inner and outer wall surfaces of the insert.

6. The drain pan of claim 2, wherein the insert has at least one opening formed in the inner and outer wall surfaces of the insert.

7. The drain pan of claim 1, wherein at least a portion of the outer wall surface of the insert is in a spaced relationship from the outer wall surface of the drain.

8. The drain pan of claim 1, wherein at least a portion of the inner wall surface of the insert has a knurled finish to increase the adhesion of the plastic of the drain to the inner wall surface of the insert.

9. The drain pan of claim 1, wherein at least a portion of the outer wall surface of the insert has a knurled finish to increase the adhesion of the plastic of the drain to the outer wall surface of the insert.

10. The drain pan of claim 1, including a length of metal pipe having at least one end with a plurality of metal threads formed on the at least one end, and the at least one threaded end of the length of metal pipe is threadedly received within the drain, and in threaded engagement with at least some of the plastic threads on the inner wall surface of the drain.

11. The drain pan of claim 1, wherein the plastic threads provide a tapered threaded connection.

12. A method for fabricating a drain pan which may collect condensate from an air conditioner, comprising the steps of:

providing a bottom wall and side walls, at least one of the side walls being formed of plastic;

providing at least one opening in one of the at least one plastic side walls for the passage of condensate;

providing a drain formed of plastic having an inner wall surface and an outer wall surface and first and second ends, with the first end being disposed adjacent to, and in fluid communication with, the at least one opening, whereby condensate may pass through the drain;

providing at least a portion of the inner wall surface of the plastic drain with a plurality of threads formed of plastic; and disposing an insert having an inner wall surface and an outer wall surface between the inner and outer wall surfaces of the plastic drain and within the plastic drain, with the inner and outer wall surfaces of the insert being completely surrounded by the plastic forming the drain.

13. The method of claim 12, wherein all the side walls are formed of plastic.

14. The method of claim 12, including the step of utilizing an annular shaped member as the drain.

15. The method of claim 12, including the step of utilizing an annular shaped member as the insert and the insert is formed of metal.

16. The method of claim 12, including the step of utilizing a metal insert having at least one opening formed in the inner and outer wall surfaces of the metal insert.

17. The method of claim 13, including the step of utilizing a metal insert having at least one opening formed in the inner and outer wall surfaces of the insert.

18. The method of claim 12, including the step of disposing at least a portion of the outer wall surface of the insert in a spaced relationship from the outer wall surface of the drain.

19. The method of claim 12, including the step of providing at least a portion of the inner wall surface of the insert with a knurled finish to increase the adhesion of the plastic of the drain to the inner wall surface of the insert.

20. The method of claim 12, including the step of providing at least a portion of the outer wall surface of the insert with a knurled finish to increase the adhesion of the plastic of the drain to the outer wall surface of the insert.

21. The method of claim 12, including the steps of providing a length of metal pipe having at least one end with a plurality of metal threads formed on the at least one end, and inserting the at least one threaded end of the length of metal pipe within the drain, and in threaded engagement with at least some of the plastic threads on the inner wall surface of the drain.

22. The method of claim 12, including the step of utilizing tapered threads.

23. A drain pan which may collect condensate from an air conditioner comprising:

a bottom wall and side walls, at least one of the side walls being formed of plastic;

at least one opening in one of the at least one plastic side walls for the passage of condensate;

a drain formed of plastic having an inner wall surface and an outer wall surface and first and second ends, the first end being disposed adjacent to, and in fluid communication with, the at least one opening, whereby condensate may pass through the drain;

at least a portion of the inner wall surface of the plastic drain having a plurality of threads formed of plastic; and an insert having an inner wall surface and an outer wall surface is disposed within the plastic drain with at least a portion of the inner wall surface of the insert being disposed in a spaced relationship from the inner wall surface of the plastic drain; and a length of metal pipe having at least one end with a plurality of metal threads formed on the at least one end, and the at least one threaded end of the length of metal pipe is threadedly received within the drain, and in threaded engagement with at least some of the plastic threads on the inner wall surface of the drain.

24. A method for fabricating a drain pan which may collect condensate from an air conditioner, comprising the steps of:

providing a bottom wall and side walls, at least one of the side walls being formed of plastic;

providing at least one opening in one of the at least one plastic side walls for the passage of condensate;

providing a drain formed of plastic having an inner wall surface and an outer wall surface and first and second ends, with the first end being disposed adjacent to, and in fluid communication with, the at least one opening, whereby condensate may pass through the drain;

providing at least a portion of the inner wall surface of the plastic drain with a plurality of threads formed of plastic; and disposing an insert having an inner wall surface and an outer wall surface within the plastic drain with at least a portion of the inner wall surface of the insert being disposed in a spaced relationship from the inner wall surface of the plastic drain; and providing a length of metal pipe having at least one end with a plurality of metal threads formed on the at least one end, and inserting the at least one threaded end of the length of metal pipe within the drain, and in threaded engagement with at least some of the plastic threads on the inner wall surface of the drain.

* * * * *